US010353316B2

(12) United States Patent
Chang et al.

(10) Patent No.: US 10,353,316 B2
(45) Date of Patent: Jul. 16, 2019

(54) PRINTING WITH METAL-SURFACE CHARGE ELEMENT IN GLOW DISCHARGE REGIME

(75) Inventors: Seongsik Chang, Santa Clara, CA (US); Michael H Lee, San Jose, CA (US); Omer Gila, Cupertino, CA (US); Paul F Matheson, San Bruno, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 582 days.

(21) Appl. No.: 14/374,230

(22) PCT Filed: Apr. 30, 2012

(86) PCT No.: PCT/US2012/035834

§ 371 (c)(1),
(2), (4) Date: Jul. 24, 2014

(87) PCT Pub. No.: WO2013/165360

PCT Pub. Date: Nov. 7, 2013

(65) Prior Publication Data

US 2014/0369717 A1 Dec. 18, 2014

(51) Int. Cl.
*G03G 15/02* (2006.01)

(52) U.S. Cl.
CPC ..... *G03G 15/0233* (2013.01); *G03G 15/0216* (2013.01)

(58) Field of Classification Search
CPC ..... G03G 15/02; G03G 15/0208; G03G 15/0216; G03G 15/0233; G03G 15/0266; G03G 2215/02; G03G 2215/021
USPC ..... 399/50, 115, 176
See application file for complete search history.

(56) References Cited

U.S. PATENT DOCUMENTS

| | | | | |
|---|---|---|---|---|
| 4,387,980 | A * | 6/1983 | Ueno et al. | 399/174 |
| 5,864,737 | A | 1/1999 | Obu et al. | |
| 7,184,676 | B2 | 2/2007 | Ota | |
| 7,493,063 | B2 | 2/2009 | Takuma et al. | |
| 7,583,914 | B2 | 9/2009 | Hatakeyama et al. | |
| 2004/0213600 | A1 * | 10/2004 | Watanabe | G03G 15/0208 399/159 |
| 2007/0014584 | A1 * | 1/2007 | Fletcher et al. | 399/50 |
| 2008/0085131 | A1 * | 4/2008 | Kitazawa et al. | 399/48 |
| 2008/0267646 | A1 * | 10/2008 | Oron et al. | 399/48 |

FOREIGN PATENT DOCUMENTS

| | | |
|---|---|---|
| JP | H09054479 | 2/1997 |
| JP | 2000029320 | 1/2000 |
| JP | 3033028 | 2/2000 |

(Continued)

OTHER PUBLICATIONS

International Search Report for Application No. PCT/US2012/035834. Report dated Jan. 2, 2013.

*Primary Examiner* — Benjamin R Schmitt
(74) *Attorney, Agent, or Firm* — HP Inc. Patent Department

(57) ABSTRACT

Techniques related to printing using a metal-surface charge element. A metal-surface charge element includes at least one metal charge roller to deposit electric charge on an imaging surface. Each metal charge roller includes a metal external surface in charge-transferring relation with the imaging surface and in a glow discharge regime during operation of the printing system for printing.

21 Claims, 13 Drawing Sheets

(56) References Cited

FOREIGN PATENT DOCUMENTS

| | | |
|---|---|---|
| JP | 2010048881 | 3/2010 |
| JP | 2010054891 | 3/2010 |
| KR | 20080083901 | 9/2008 |

* cited by examiner

PRINTING WITH METAL-SURFACE CHARGE ELEMENT IN GLOW DISCHARGE REGIME

BACKGROUND

High-speed digital printing systems, of which an example is the Indigo printing system by Hewlett-Packard Company, have progressed to the point that the output is virtually indistinguishable from the high-quality printing that formerly was associated only with offset lithography. This new digital printing technology uses inks that can be attracted or repelled by a static electric charge. A uniform charge is placed on an imaging surface, for example a photoconductor, by a voltage differential between the electrical ground beneath the imaging surface and a charging element, such as a charge roller. The charge roller comprises a metal shaft coated with an electrically resistive composition such as polyurethane rubber with conductive species; this rubber coating assures uniform charge distribution on the imaging surface. Then a pattern is formed in the charge on the imaging surface by a scanning laser. Inks of various colors are applied and adhere to the imaging surface according to the charge pattern. These patterns of ink are then transferred onto paper. The ink is specially formulated so as not to mask the underlying surface roughness or glossiness of the paper.

BRIEF DESCRIPTION OF THE DRAWINGS

The figures are not drawn to scale. They illustrate the disclosure by examples.

DETAILED DESCRIPTION

Figure 1:
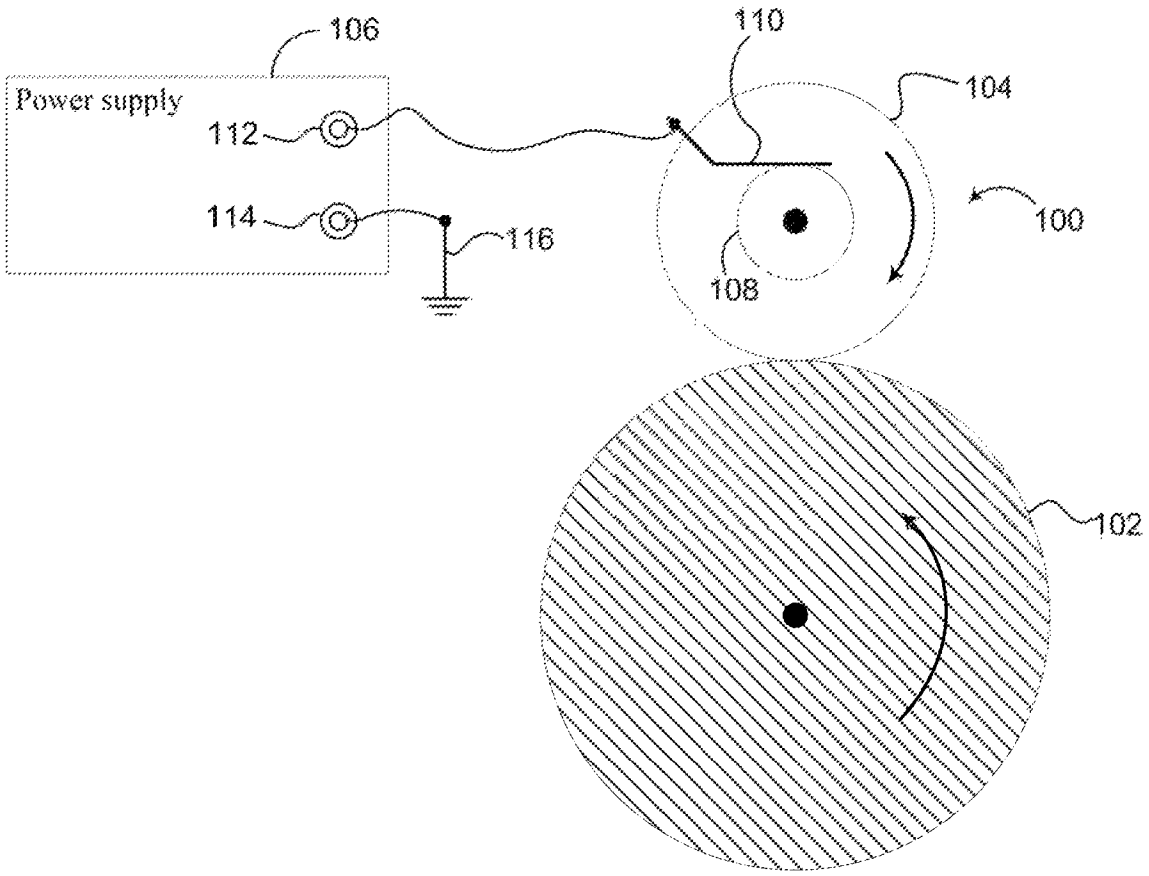
FIG. 1 is a partial schematic of an example of a printing system having a metal-surface charge element.

Illustrative examples and details are used in the drawings and in this description, but other configurations may exist and may suggest themselves. Parameters such as voltages, temperatures, dimensions, and component values depend on the exact printing system implementation and are approximate for some typical indigo printing systems. Terms of orientation such as up, down, top, and bottom are used only for convenience to indicate spatial relationships of components with respect to each other, and except as otherwise indicated, orientation with respect to external axes is not critical. "Ground" refers to a common return, not necessarily to any earth ground. For clarity, some known methods and structures have not been described in detail. Methods defined by the claims may comprise steps in addition to those listed, and except as indicated in the claims themselves the steps may be performed in another order than that given. Accordingly, the only limitations are imposed by the claims, not by the drawings or this description.

Charging elements such as charge rollers used in high-speed digital printing systems have a finite lifetime because their rubber deteriorates with use. Although this lifetime may be measured in hundreds of thousands of printed sheets of paper, these presses have such high throughput that the charging elements may need to be replaced as often as every several days. The frequent replacements of charging elements can add to the total cost of operating the printing system. There is a need for a way to reduce or eliminate the need for replacement of charging elements in high-speed digital printing without compromising print quality. This may be particularly advantageous with printers characterized by a high throughput and print quality, such as liquid electrophotographic printers, of which the Indigo printing system by Hewlett-Packard Company is an example. Electrophotographic printing encompasses a print system in which a discharge source (e.g., a laser beam scanner) scans a charged imaging surface (e.g., a photoconductor) to form an electrostatic latent image on the imaging surface; a liquid ink developer of a selected color is applied to the electrostatic latent image to develop the electrostatic latent image; and the developed image is printed on a print medium via a transfer unit (e.g., an intermediate transfer drum and an impression drum). At least some of the examples below are illustrated with respect to liquid electrophotographic printers. However, examples are not limited to liquid electrophotographic printers.

An example of a printing system with a metal-surface charging element is shown in FIG. 1. The metal-surface charging element includes at least one metal charge roller generally 100 to deposit electric charge on an imaging surface 102. The metal charge roller includes a metal external surface 104 in charge-transferring relation with the imaging surface and in a glow discharge regime during operation of the printing system for printing.

In some examples a power supply 106 provides electric charge to each metal charge roller at a potential within the glow discharge regime. The metal external surface 104 of the metal charge roller 100 is disposed to make rolling physical contact with, and to deposit electric charge on, the imaging surface 102. No compositions or other conductive agents come between the metal charge roller and the imaging surface. The benefit of using a metal-surface charging element is that it can last for the lifetime of the printing system with little or no degradation, or at least with lower degradation than a conventional charging element designed for being operated with a composition surface in charge-transferring relation with the imaging surface to deposit electric charge on the imaging surface. That is why the metal-surface charge element is sometimes referred to in this description as "permanent". However, the metal-surface charge element may be releasably mounted in the printing system to facilitate replacement if required. In some examples each metal charge roller comprises either a solid metal cylinder or a hollow metal cylinder as described in more detail presently.

The metal charge roller 100 carries a slip contact 108 in electrical communication with a contact arm 110 that in turn is connected to a first power output terminal 112 of the power supply 106. A second power output terminal 114 is connected to a common return 116 and through the return to the imaging surface 102. In other examples, other connection techniques are instead used to couple electric power from the power supply across the metal charge roller and the imaging surface.

Figure 2:
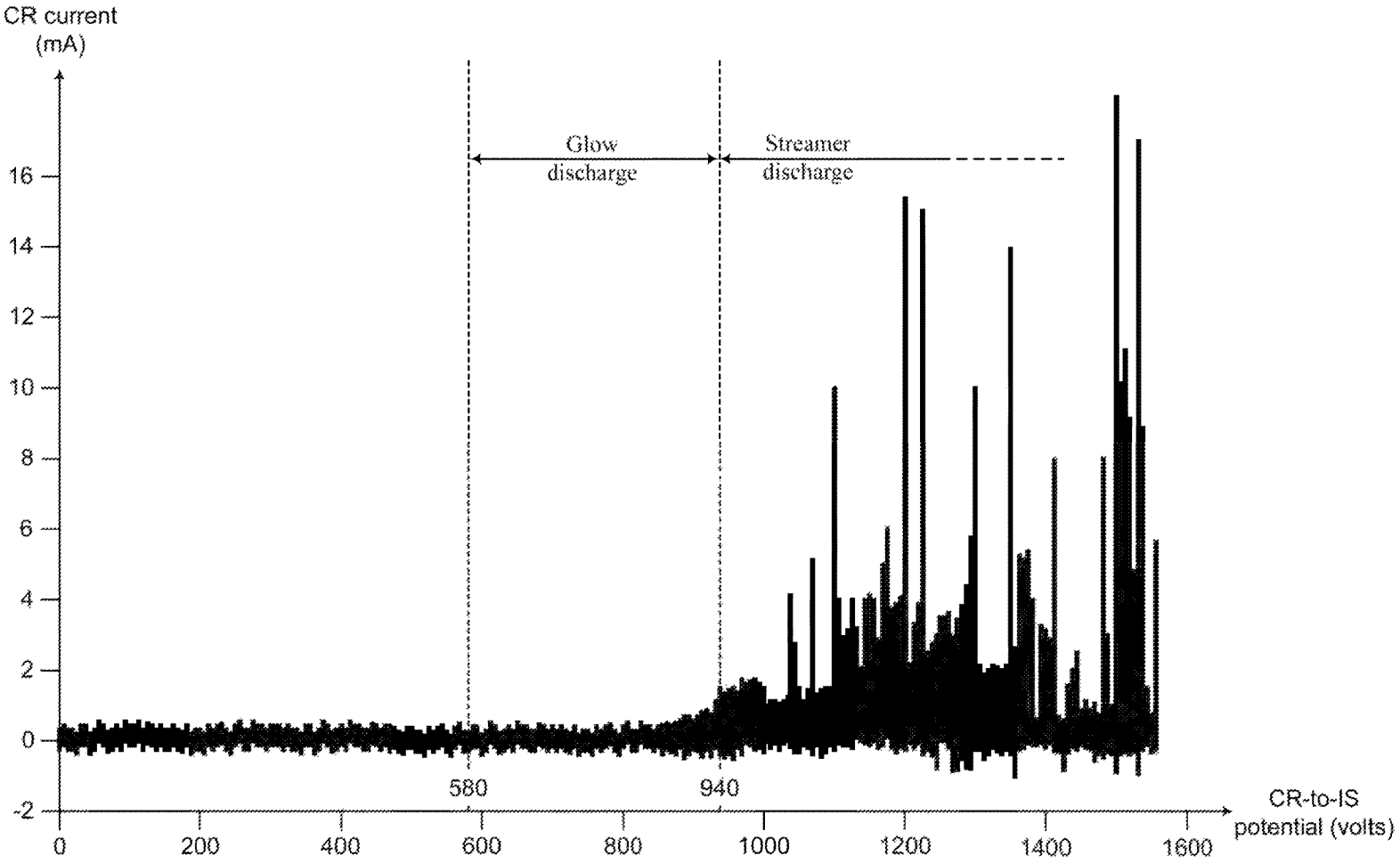
FIG. 2 is an example of a current-voltage plot of a metal charge roller in charge-transferring relation with an imaging surface.

If the voltage on the metal-surface charge element is too high with respect to the imaging surface, streamers—localized filamentary breakdowns in the air under the influence of large electric fields—can occur. FIG. 2 illustrates a current-voltage characteristic of a typical metal charge roller ("CR") when in charge-transfer relationship with an imaging surface "IS"). In this example, the glow discharge region begins when the potential difference between the metal charge roller and the imaging surface reaches about 580 volts, and the streamer discharge region begins when this potential difference reaches about 940 volts. In the streamer discharge region, large current fluctuations indicate formation and discharge of streamer filaments. Any one of these filaments may have a diameter of only 100 micrometers (μm) and last only 100 nanoseconds (ns), but they recur frequently and they cause a non-uniform distribution of charge on the imaging surface.

Figure 3:
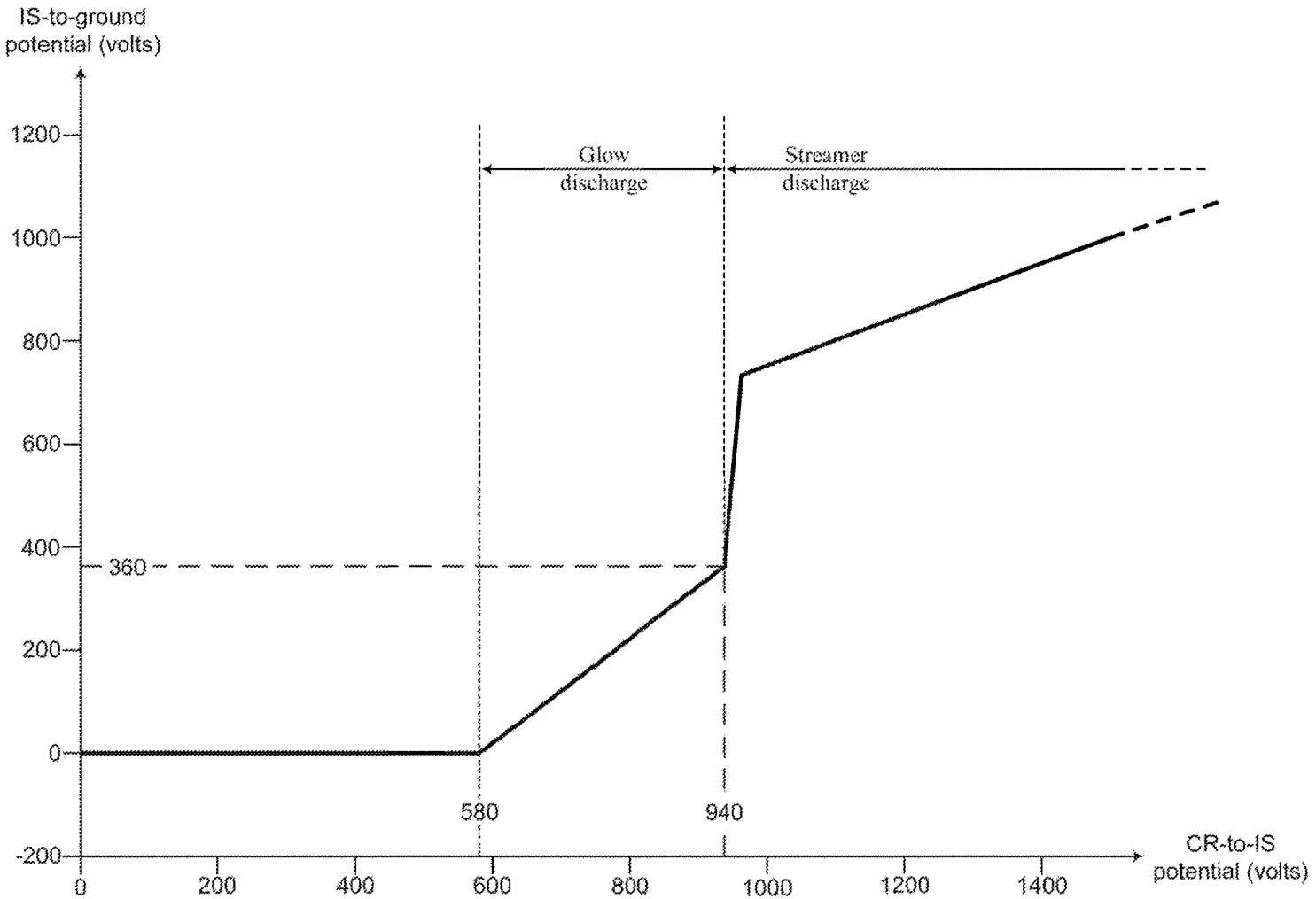
FIG. 3 is a plot of the potential to which the imaging surface in the example of FIG. 2 can be charged by a given potential of the metal charge roller, and showing glow discharge and streamer discharge regimes.

FIG. 3 shows bow much charge will be deposited on the imaging surface in the example of FIG. 2 by any given potential of the metal charge roller. The metal charge roller enters the glow discharge regime when its potential exceeds a first threshold with respect to the imaging surface. This threshold is about 580 volts in the example of FIG. 3. Glow discharge results in uniform charge distribution on the imaging surface. A charge-roller potential of 940 volts charges the imaging surface up to a potential of about 360 volts with respect to ground, as can be determined by moving vertically from the horizontal axis at the 940-volt point up to the curve and from there horizontally to the vertical axis. Thus, glow discharge can be maintained up to an imaging-surface potential of about 360 volts. If the charge-roller potential with respect to the imaging-surface is higher than the second threshold, streamer discharge occurs, leading to non-uniform charge distribution. Non-uniform charge distribution in turn leads to unacceptable alligator patterns in the primed output. Accordingly, the power supply is set to provide a potential only high enough to operate the metal charge roller within a normal glow discharge regime but not within a streamer discharge regime.

A single metal charge roller may suffice in a printer system that requires less than about 340 volts on its imaging surface because a single metal charge roller can charge an imaging surface to that potential and still remain in the glow discharge regime. Some printer systems require an imaging surface potential of more than 500 volts. A single metal charge roller may not be able to supply a uniform charge distribution at that potential because it may be operating in the streamer regime.

The potential that will push a metal charge roller into the streamer discharge region in a given printer system depends on various physical and other system parameters. Some printer systems require the imaging surface to be charged to about 1,000 volts with respect to ground for proper print operation. This is the case, for example, in some Indigo digital presses. The minimum streamer discharge potential of as metal charge roller in such a system is about 940 volts, but to charge the imaging surface to 1,000 volts requires a potential of about 1,600 volts on the metal charge roller with respect to the imaging surface, and this is well into the streamer discharge region. The system can be kept within the glow discharge region by charging the imaging surface in stages with multiple metal charge rollers rather than all at once. The potential difference between the metal-surface charge element and the imaging surface at any stage is kept below the streamer discharge region, thereby assuring uniform charge distribution on the imaging surface.

Figure 4:
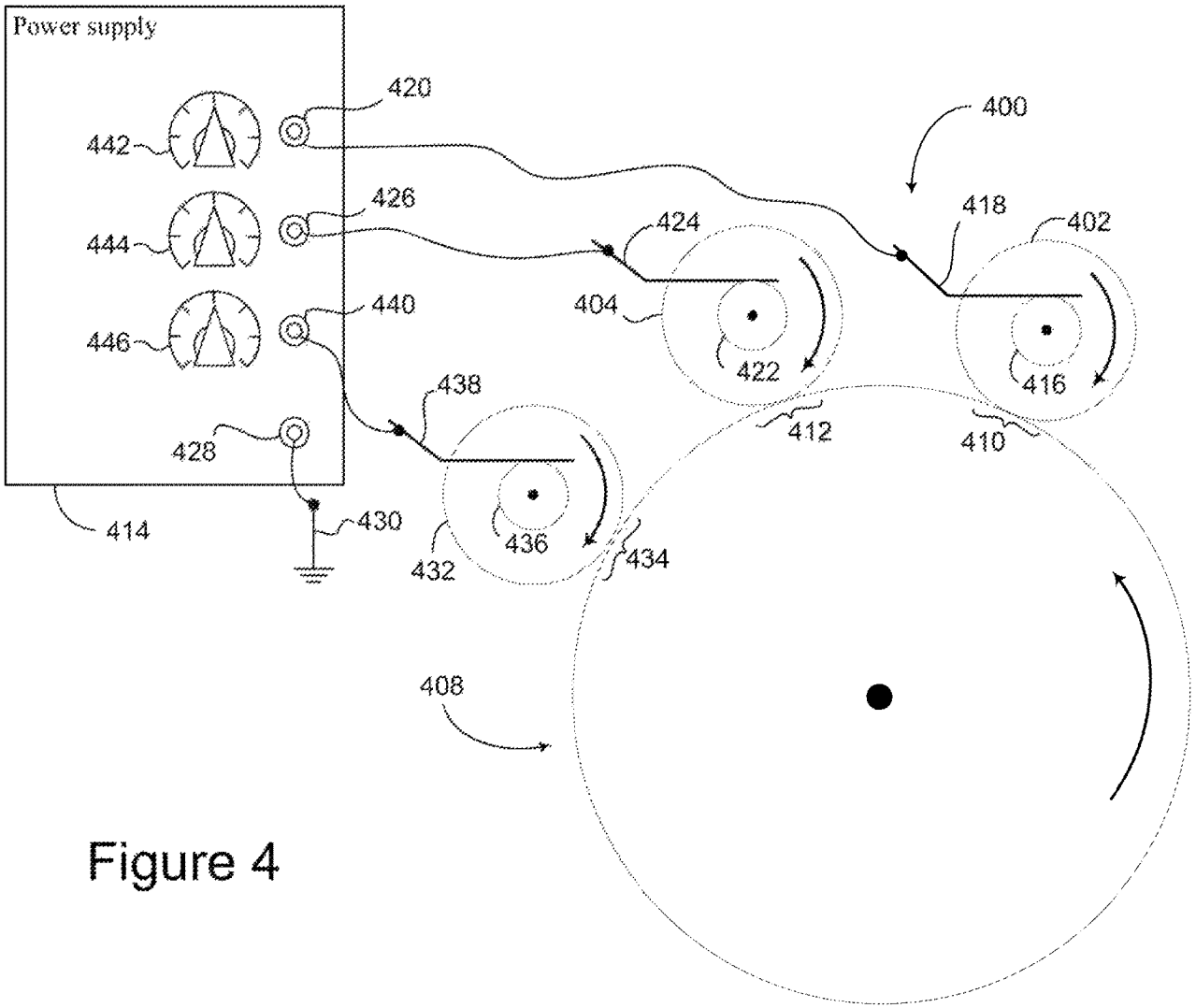
FIG. 4 is a partial schematic of an example of a printing system having a metal-surface charge element with more than one metal charge roller.

FIG. 4 gives an example of a printing system in which a metal-surface charge element 400 comprises at least two metal charge rollers 402 and 404 disposed to deposit electric charge on an imaging surface 408 in increments such that, during operation of the printing system for printing, each metal charge roller deposits an increment of a required electric charge on the imaging surface. For example, the metal charge roller 402 deposits a first increment of a required charge at a location 410 an the imaging surface and the metal charge roller 404 deposits a second increment of a required charge at a location 412 on the imaging surface.

In some examples a power supply 414 provides electric charge to the first metal charge roller 402 at a potential within the glow discharge regime between the first metal charge roller 402 and the imaging surface 408 and to each metal charge roller after the first at a potential within the glow discharge regime between that metal charge roller and the imaging surface after being charged by the previous metal charge roller.

In this example the first metal charge roller 402 carries a slip contact 416 in electrical communication with a contact arm 418 that in turn is connected to a first power output terminal 420 of the power supply 414. The second metal charge roller 404 carries a slip contact 422 in electrical communication with a contact arm 424 that in turn is connected to a second power output terminal 426 of the power supply 414. A common return power terminal 428 is connected to a around (common return) 430 and through the return to the imaging surface 408. In other examples, other connection techniques are instead used to connect the power supply to the metal charge rollers and the imaging surface.

In another example, the printer system includes a third metal charge roller 432 disposed to deposit electric charge on the imaging surface 408 in an increment such that, during operation of the printing system for printing, the metal charge roller 432 deposits that increment of the required electric charge on the imaging surface. For example, the metal charge roller 432 deposits a third increment of the required charge at a location 434 on the imaging surface. The power supply 414 provides electric charge to the third metal charge roller 432 at a potential within the glow discharge regime between the third metal charge roller 432 and the imaging surface 408. Additional metal charge rollers may be similarly disposed and provided with electric charge. The third metal charge roller 432 carries a slip contact 436 in electrical communication with a contact arm 438 that in turn is connected to a third power output terminal 440 of the power supply 414.

Thresholds for glow discharge and streamer discharge depend on specific geometric parameters, material parameters, and environmental parameters of a given printing system. In the example of FIGS. 2 and 3, the glow discharge threshold is about 580 volts and the streamer discharge threshold is about 940 volts. Geometric parameters include, for example, imaging surface thickness, metal charge roller diameter, and the width of any gap between the metal charge rollers and the imaging surface. Material parameters include, for example, dielectric constant of the imaging surface and surface properties of the metal charge rollers. Environmental parameters include, for example, ambient pressure, temperature, and humidity. The maximum potential to which the imaging surface can be charged in the glow-discharge regime by each metal charge roller depends on these parameters. Accordingly, the number of metal charge rollers needed to charge the imaging surface to a desired potential is determined by these parameters.

In order to find a proper operating voltage for a specific printing system at a specific location, temperature, and humidity, a calibration procedure may be used to find the streamer threshold and the glow discharge threshold. By knowing these parameters, the imaging surface potential that can be achieved by each metal charge roller can be measured, and therefore, operating voltages and the number of metal charge rollers can be determined. For example, charge-roller current can be monitored. The glow discharge criteria, such as current amplitude, can be set to a value less than, for example, about 0.4 milliamps (mA) and temporal current fluctuation should be less than about 0.1 mA for the printer depicted in FIGS. 2 and 3. As the charge-roller voltage is ramped up, the charge-roller voltage that starts exceeding glow discharge criteria is the streamer discharge threshold. Glow discharge threshold can be easily determined by a criterion such as charge-roller current greater than zero or imaging surface voltage greater than zero.

The power supply 414 includes a first potentiometer 442 that controls the potential at the first output terminal 420, a second potentiometer 444 that controls the potential at the second output terminal 426, and a third potentiometer 446 that controls the potential at the third output terminal 440. Setting the first potentiometer 442 to provide a voltage of about 940 volts to the first metal charge roller 402 results in charging the imaging surface to about 360 volts, within the glow discharge regime and below the streamer discharge regime. Setting the second potentiometer 442 to provide a voltage of about 1,300 volts (with respect to ground) to the second metal charge roller 404 results in charging the imaging surface an additional 360 volts (again, a value within the glow discharge regime and below the streamer discharge regime) to about 720 volts total. Setting the third potentiometer 446 to provide a voltage of about 1,660 volts (with respect to ground) to the third metal charge roller 432 charges the imaging surface an additional 360 volts to about 1,080 volts total, sufficient for the printer to operate. In other examples, other techniques may be used to set the power supply to provide appropriate voltages to each metal charge roller.

In still other examples, more than three metal charge rollers may be used as the metal-surface charge element. The first such metal charge roller is provided with electric charge at a potential within the glow discharge potential between that metal charge roller and the imaging surface when not charged. Each metal charge roller after the first is provided with electric charge at a potential within the glow discharge potential between it and the imaging surface as charged by the previous metal charge roller.

Figure 5:
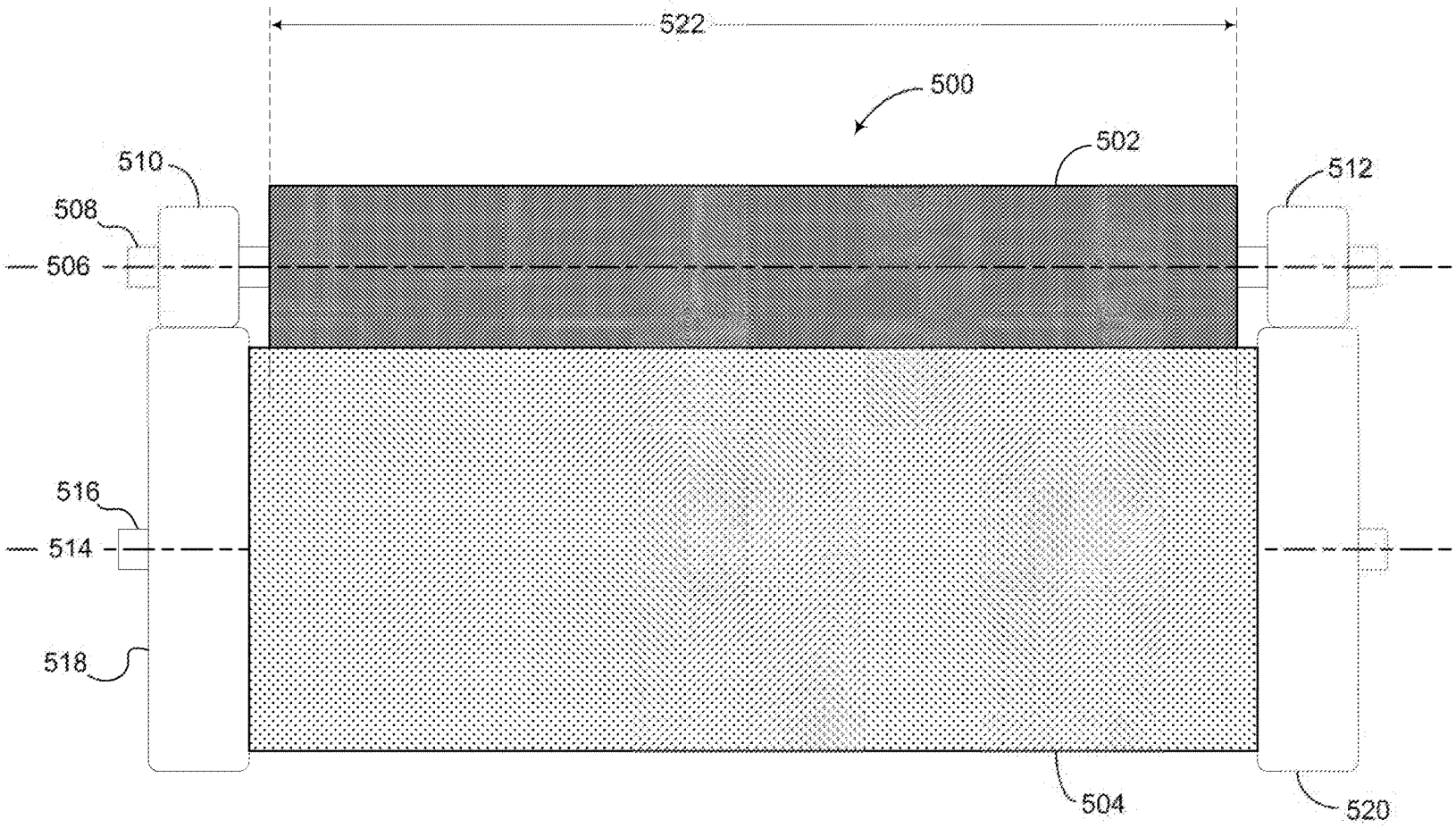
FIG. 5 is a side view of an example of a printing system having a metal charge roller in contact with an imaging surface.

FIG. 5 shows an example in which a metal-surface charge element generally 500 comprises a metal charge roller 502 rotationally coupled to an imaging surface 504. As discussed below, the imaging surface may comprise a drum covered with a photoconducting sheet. The metal charge roller 502 is in direct physical contact with the imaging surface 504. The metal charge roller 502 rotates about an axis 506 by means at a shaft 508 and is driven by the rotation of the imaging surface. A drive wheel 510 may be placed on one end of the shaft 508 and a drive wheel 512 may be placed on the other end of the shaft 508, for example in an Indigo implementation in which the imaging surface comprises a photoconducting sheet with a discontinuous seam region (not shown) resulting from overlap of two ends of the sheet. Such a seam region this be slightly depressed relative to other portions of the imaging surface. The imaging surface 504 rotates about an axis 514 by means of a shaft 516. Disks 518 and 520 are attached to opposing sides of the imaging surface. The drive wheel 510 touches the disk 518 only when the seam region approaches the metal charge roller 502, thereby preventing direct charge-roller contact with the seam region to avoid transferring excessive oil accumulated in the seam region onto the metal charge roller or other portions of the imaging surface. Similarly, the drive wheel 512 touches the disk 520 only when the seam region approaches the metal charge roller 502. Torque to rotate the imaging surface and the metal charge roller may be provided by a motor (not shown) that drives the shaft 516, for example through a gear (not shown) attached to the shaft 516. In this example the metal charge roller is slightly shorter than the imaging surface and defines an image area 522 on the imaging surface so as to avoid creating a short between the metal charge roller and the imaging surface ground.

Figure 6:
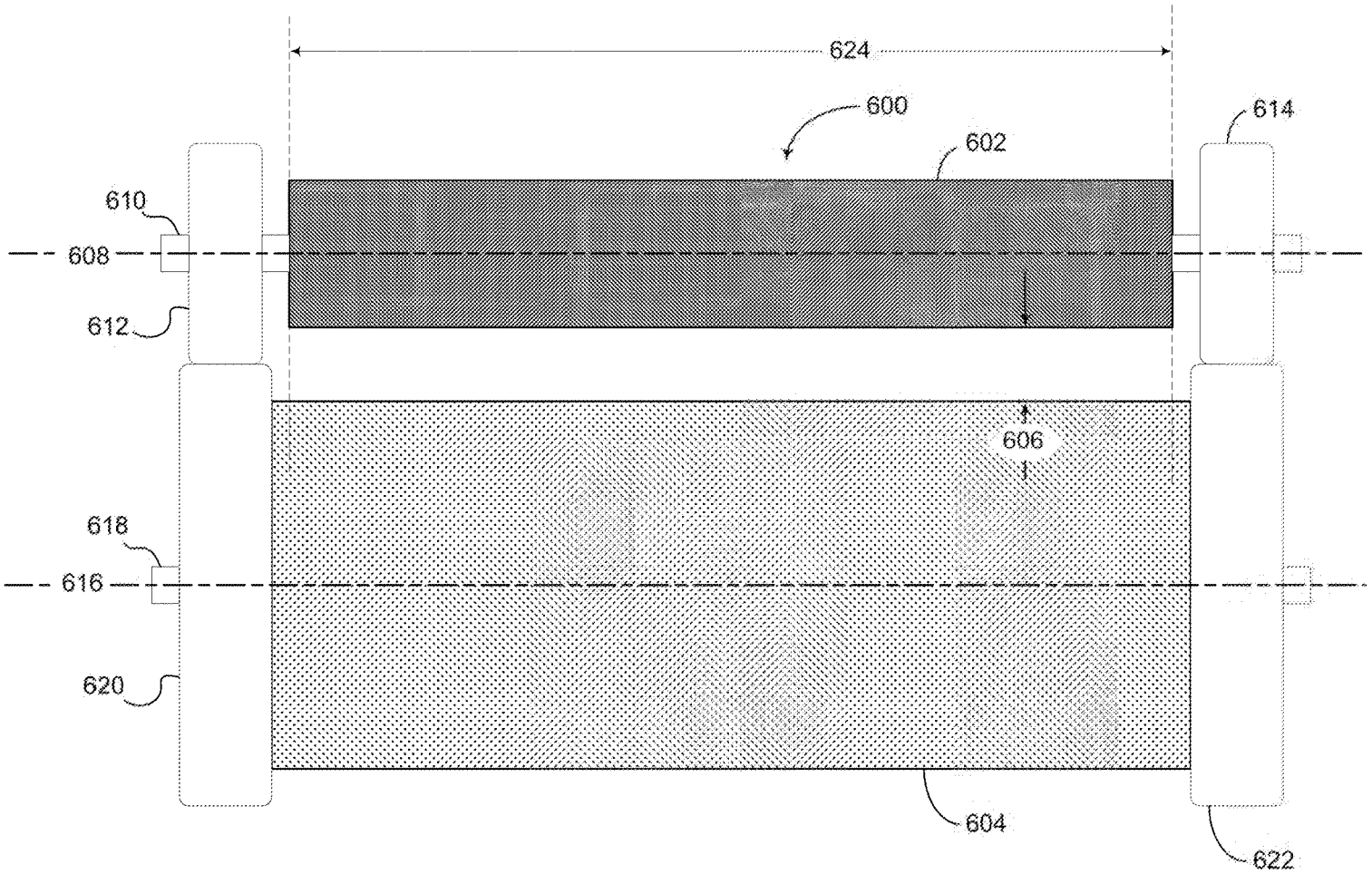
FIG. 6 is a side view of an example of a printing system having a metal charge roller spaced apart from an imaging surface.

FIG. 6 shows an example in which a metal-surface charge element generally 600 comprises a metal charge roller 602 rotationally coupled to an imaging surface 604. The metal charge roller 602 is spaced apart from the imaging surface by a gap 606. The gap 606 may be any width up to about 20 micrometers or even larger if adequate, uniform charge transfer can be achieved. The metal charge roller 602 rotates about an axis 608 by means of a shaft 610 coupled to a drive wheel 612 on one end and a drive wheel 614 on the other end. The imaging surface rotates about an axis 616 by means of a shaft 618 with an imaging surface disk 620 on one end and an imaging surface disk 622 on the other end. The charge-roller drive wheel 612 engages the imaging surface disk 620, and the charge-roller drive wheel 614 engages the imaging surface disk 622. As with the previous example, there may be more or fewer drive wheels and disks, and rotational torque to the imaging surface may be provided by a motor (not shown) through a gear (not shown) attached to the shaft 618. The metal charge roller 603 defines an image area 624 on the imaging surface.

Figure 7:
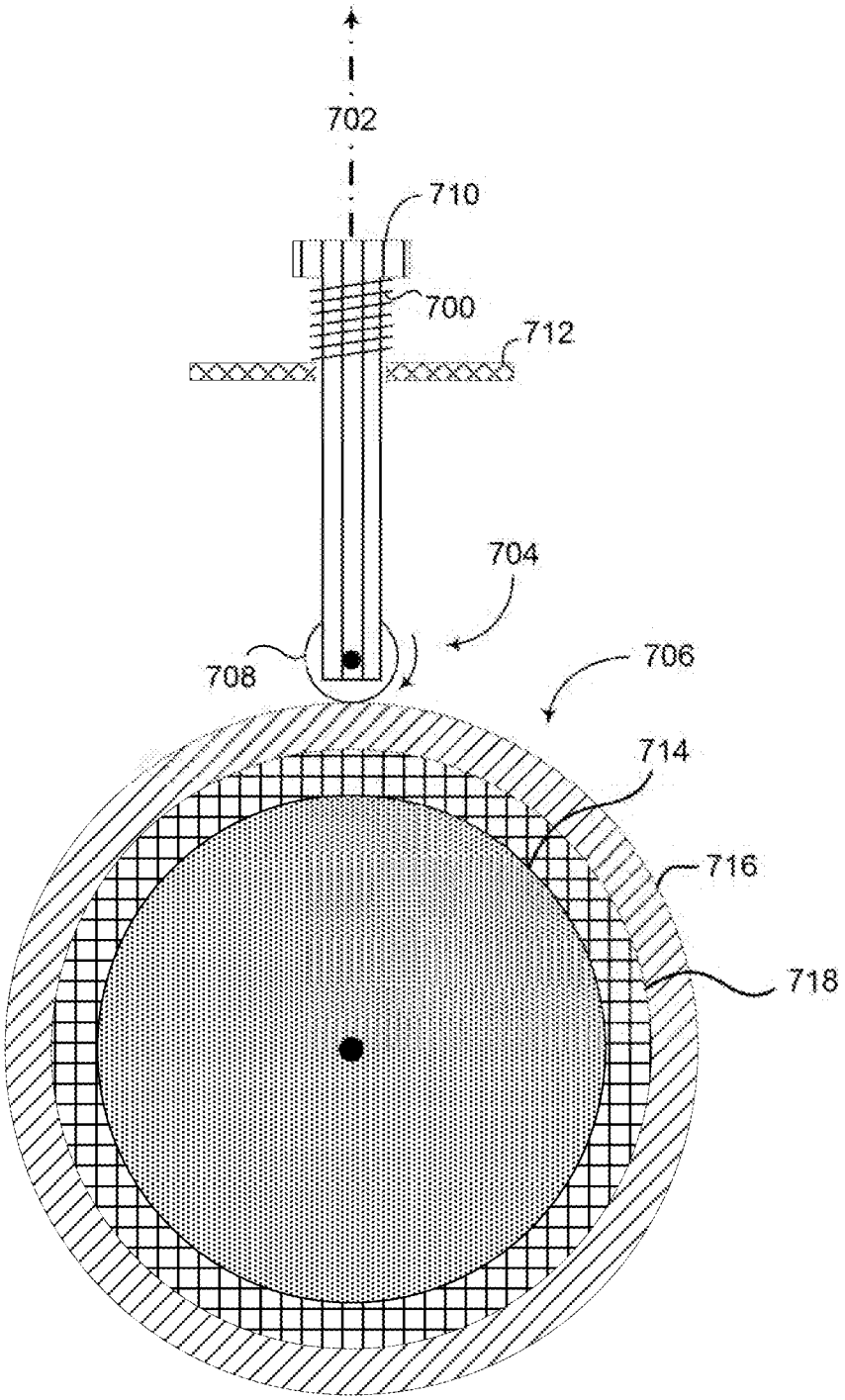
FIG. 7 is a schematic representation of an example of a printing system having a metal-surface charge element with a biasing spring.

As shown in FIG. 7, some examples include a spring 700 that exerts a force 702 between a metal-surface charge element 704 and an imaging surface 706. In this example the metal-surface charge element 704 has only one metal charge roller 708, but in other examples the metal-surface charge element 704 comprises more than one metal charge roller, as described previously. In this example the metal-surface charge element 704 is disposed above the imaging surface 706 such that gravity urges the metal-surface charge element into contact with the imaging surface. The gravitational force may be too great, especially for a metal-surface charge element that comprises one or more solid metal rollers, and may result in damage to the surface of the metal charge rollers or the imaging surface. The force 702 exerted by the spring is generally opposite to the force of gravity, reducing the net force with which the metal-surface charge element is pressed against the imaging surface. The spring is compressed between a support arm 710 that carries the metal-surface charge element and a fixed plate 712. In other examples the spring may be connected such that it urges the metal-surface charge element against the imaging surface, for example if more force is needed to ensure adequate contact between the metal-surface charge element and the imaging surface or if the metal-surface charge element is not oriented vertically above the imaging surface.

Also as shown in FIG. 7, in some examples the imaging surface 706 comprises a drum 714 covered with a flexible deformable photoconducting sheet 716 which may be made of polymer material. A slightly compressible material such as fabric 718 may be disposed between the drum 714 and the photoconducting sheet 716. In other examples the imaging surface 706 comprises a dielectric drum, and no photoconducting sheet is used.

Figure 8:
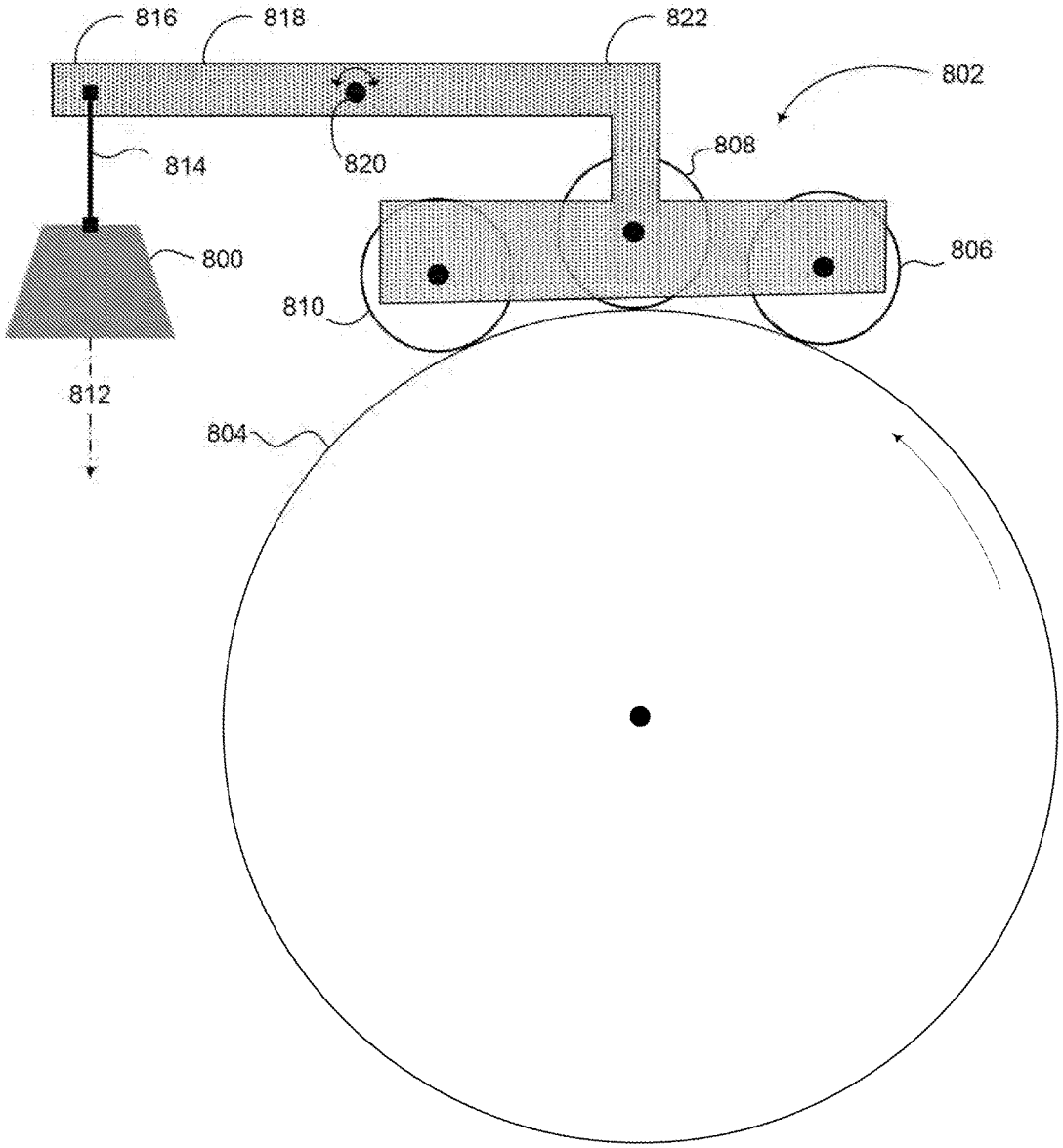
FIG. 8 is a schematic representation of an example of a printing system having a metal-surface charge element with a biasing weight.

Referring to FIG. 8, in some examples a weight 800 exerts a biasing force between a metal-surface charge element 802 and an imaging surface 804. In this example the metal-surface charge element 802 comprises a first metal charge roller 806, a second metal charge roller 808, and a third metal charge roller 810, all in direct contact with the imaging surface 804. The weight 800, under the influence of gravity, exerts a downward force 812 through a connecting rod 814 on a first extremity 816 of a lever arm 818, urging the lever arm to pivot about its fulcrum 820 and exert an upward force on a second extremity 822 of the lever arm 818 that carries the metal-surface charge element 802. This reduces the gravitational force that urges the metal-surface charge element 802 against the imaging surface 804. If more force rather than less is needed to urge the metal-surface charge element 802 into contact with the imaging surface 804, the positions of the weight 800 and the fulcrum 820 may be exchanged.

Figure 9:
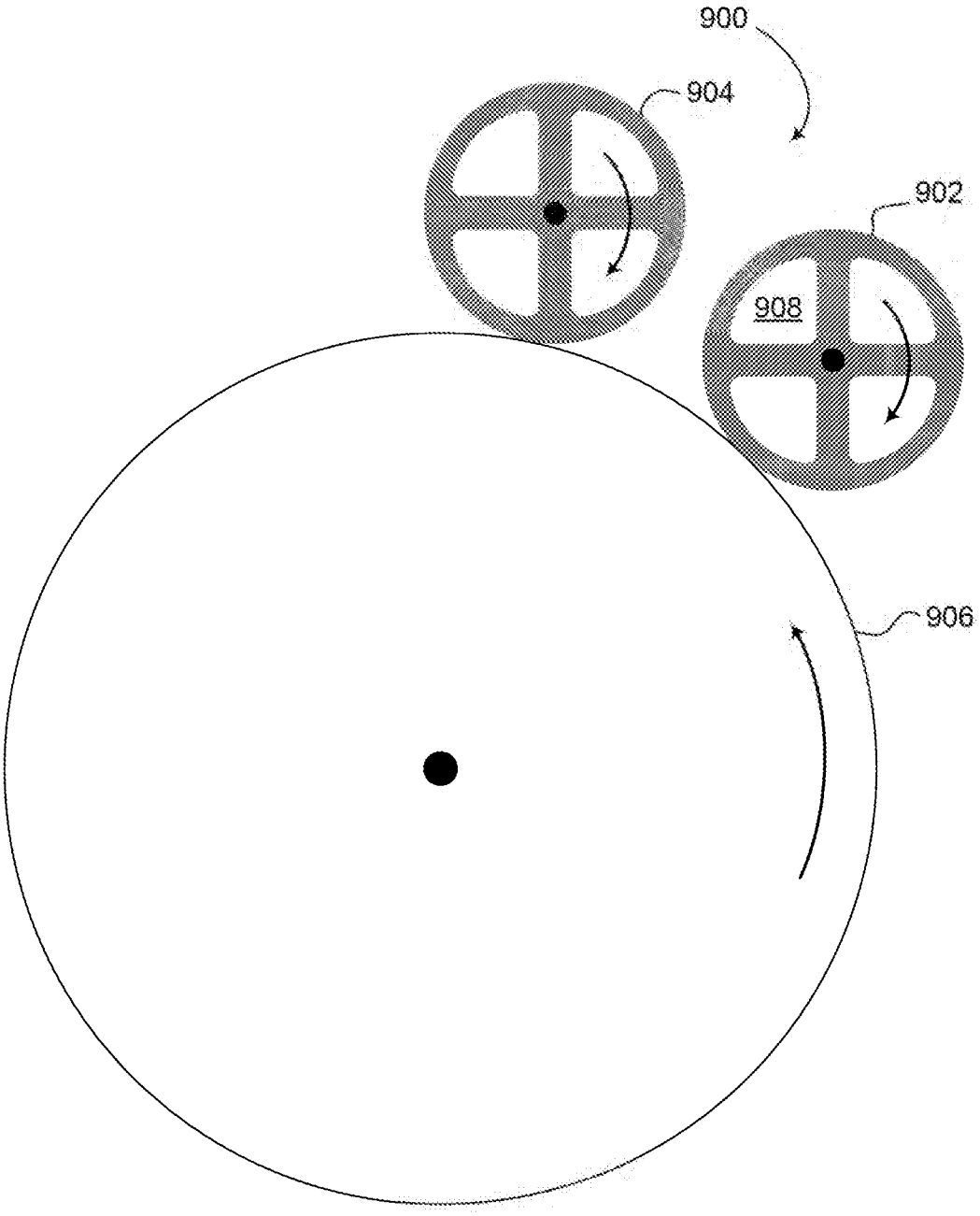
FIG. 9 is a schematic representation of an example of a printing system having a hollow metal charge roller.

In some of the above examples, the metal-surface charge element comprises one or more solid metal cylinders with metal surfaces. In another example, as shown in FIG. 9, a metal-surface charge element 900 having two metal charge rollers 902 and 904 contacts an imaging surface 906. Each of the metal charge rollers comprises a hollow metal cylinder enclosing air spaces such as an air space 908 in the first metal charge roller 902. Making the metal charge rollers hollow reduces their weight and thereby reduces reduce the gravitational force that urges them against the imaging surface.

Figure 10:
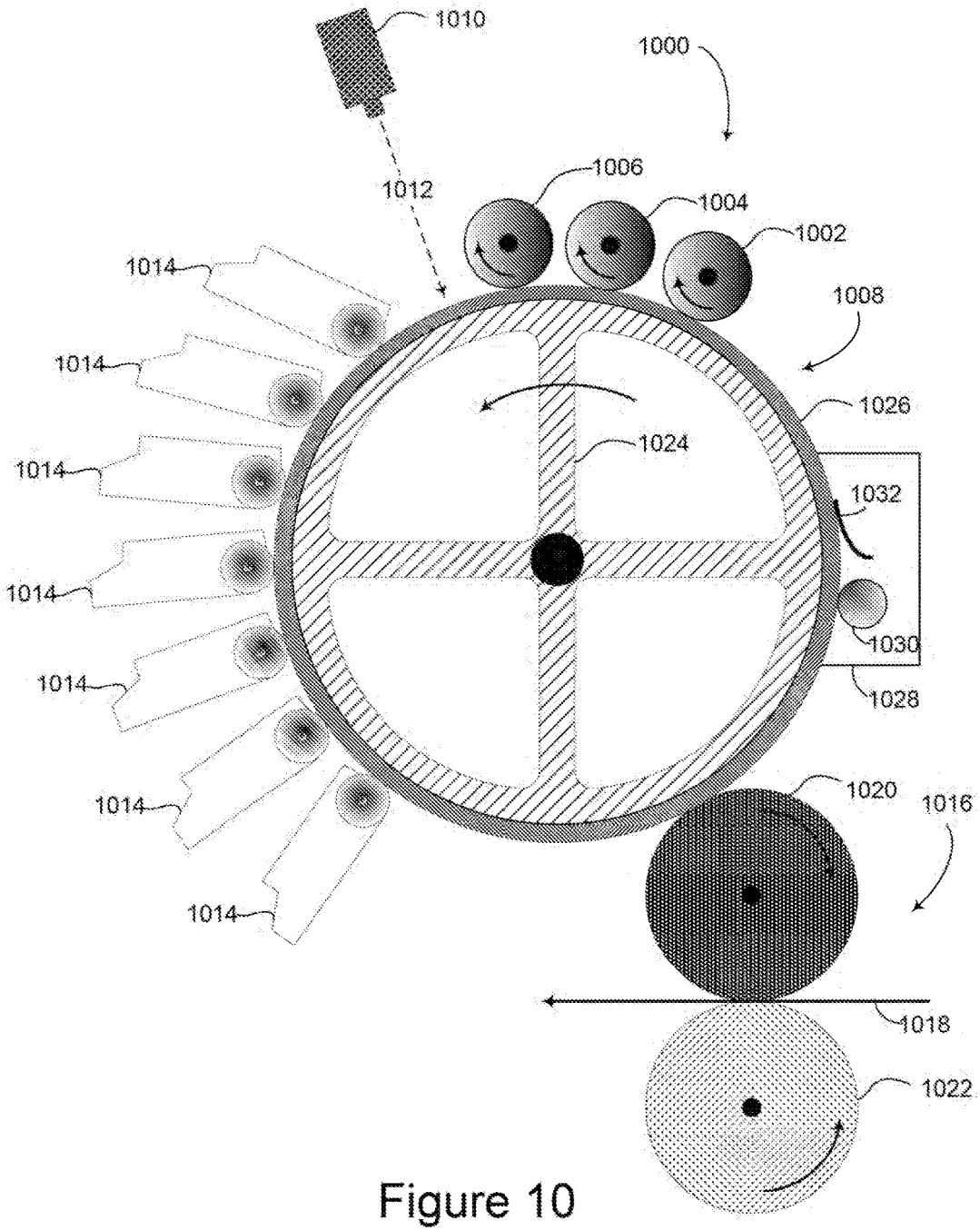
FIG. 10 is a schematic representation of an example of a printing system having a metal-surface charge element that includes one or more metal charge rollers.

FIG. 10 gives an example of a printing system having a metal-surface charge element generally 1000 that includes one or more metal charge rollers in charge-transferring relation with an imaging surface 1008. In this example there are three metal charge rollers 1002, 1004, and 1006, but as discussed above, in other printing systems there may be one, two, or more than two. A discharge source 1010 is aimed at the imaging surface 1008 as indicated by an arrow 1012. At least one ink developer roller 1014 is disposed in ink-dispensing relation with the imaging surface 1008; in this example there are seven ink dispenser rollers but in other examples fewer or more may be used. A transfer unit generally 1016 is in ink-transferring relation with the imaging surface 1008. The transfer unit 1016 defines a paper movement path 1018.

A power supply (not shown), similar to the power supplies discussed above, provides electric charge to the first metal charge roller 1002 at a potential between that metal charge roller and the imaging surface that is within a glow discharge regime, and to each subsequent metal charge roller at a potential between that metal charge roller and the imaging surface after being charged by the previous metal charge roller that is within the glow discharge regime.

In some examples the transfer unit 1016 comprises an intermediate transfer drum 1020 rotationally coupled to and in direct contact with the imaging surface 1008 and an impression drum 1022 rotationally coupled to the intermediate transfer drum 1020. The paper movement path 1018 is defined between the intermediate transfer drum 1020 and the impression drum 1022.

The imaging surface 1008 may comprise a drum 1024 and a photoconducting sheet 1026 carried by the drum. As discussed previously, fabric or other material (not shown) may be disposed between the drum and the photoconducting sheet. In other examples the imaging surface 1008 may comprise a dielectric drum as discussed previously.

In this example the discharge source 1010 comprises a laser. In operation, when a beam of light from the laser reaches points on the electrostatically-charged imaging surface 1008, the light discharges the surface at those points. A charge image is formed on the imaging surface by scanning the beam of light across the imaging surface. Instead of the laser, depending on what kind of imaging surface is used, other examples may use another kind of image-forming energy source or addressable discharging system such as an ion head or other gated atmospheric charge source.

Other components may also be included. For example, there may be an ink-removing component 1028 with one or more of a roller 1030 and a scraping or brushing element 1032, or other devices to remove any excess ink remaining on the imaging surface after transferring imaged ink to the transfer roller.

Figure 11:
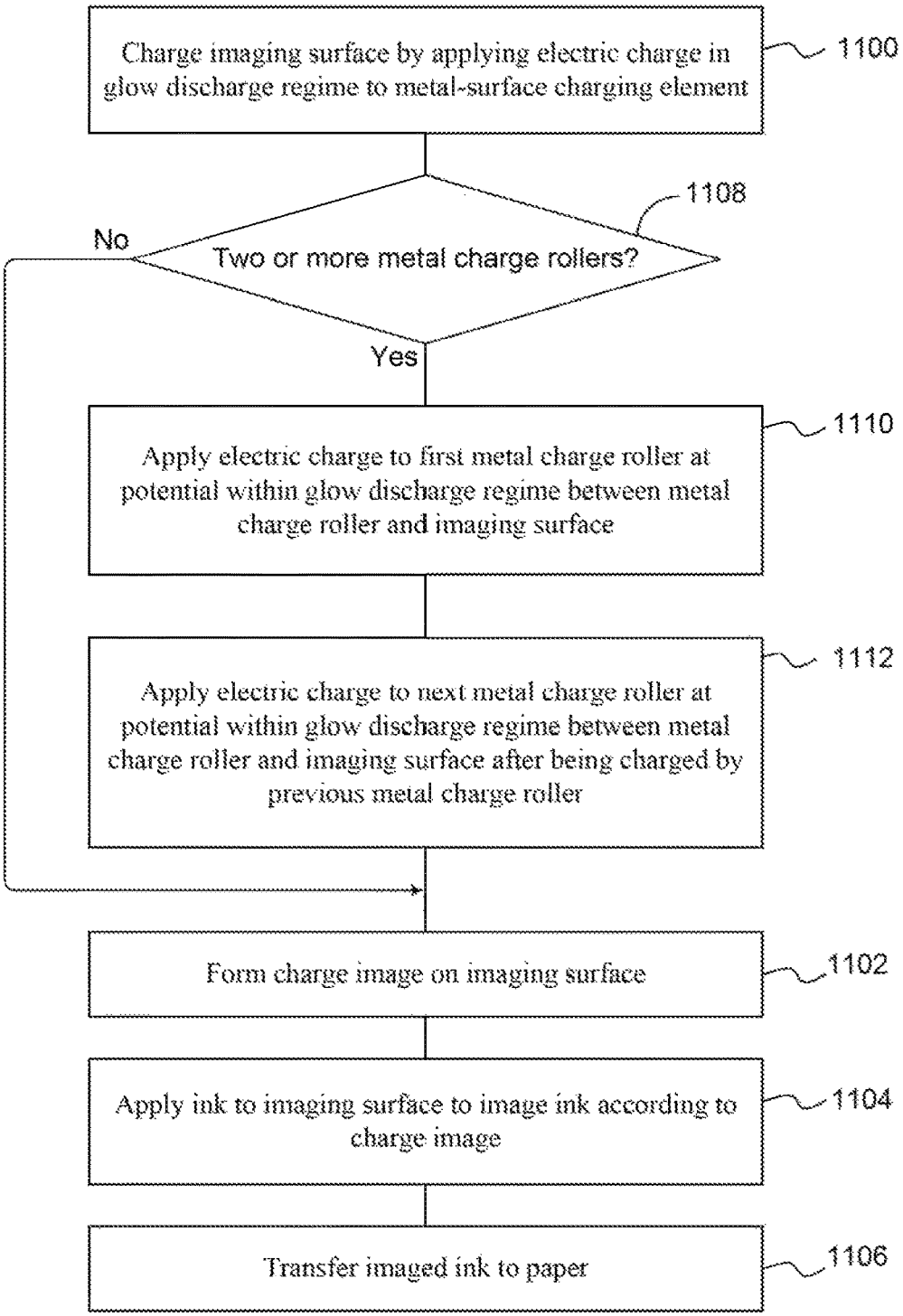
FIG. 11 is a flowchart giving an example of a method of printing with a metal-surface charge element.

FIG. 11 gives an example of a method of operating a printer with a metal-surface charge element. The method includes electrically charging an imaging surface of the printer by applying electric charge in a glow discharge regime to a metal-surface charge element that includes at least one metal charge roller, each metal charge roller in rotational and charge-transferring relation with the imaging surface (1100), forming a charge image on the electrically-charged imaging surface (1102), applying ink to the imaging surface to image the ink according to the charge image (1104), and transferring the imaged ink to paper (1106).

In some examples the metal-surface charge element includes at least two metal charge rollers. If there are two or more metal charge rollers (1108), electrically charging the imaging surface comprises applying electric charge to a first one of the metal charge rollers at a potential within the glow discharge regime between the first metal charge roller and the imaging surface (1110) and to each metal charge roller after the first at a potential within the glow discharge region between that metal charge roller and the imaging surface after being charged by the previous metal charge roller (1112).

Figure 12:
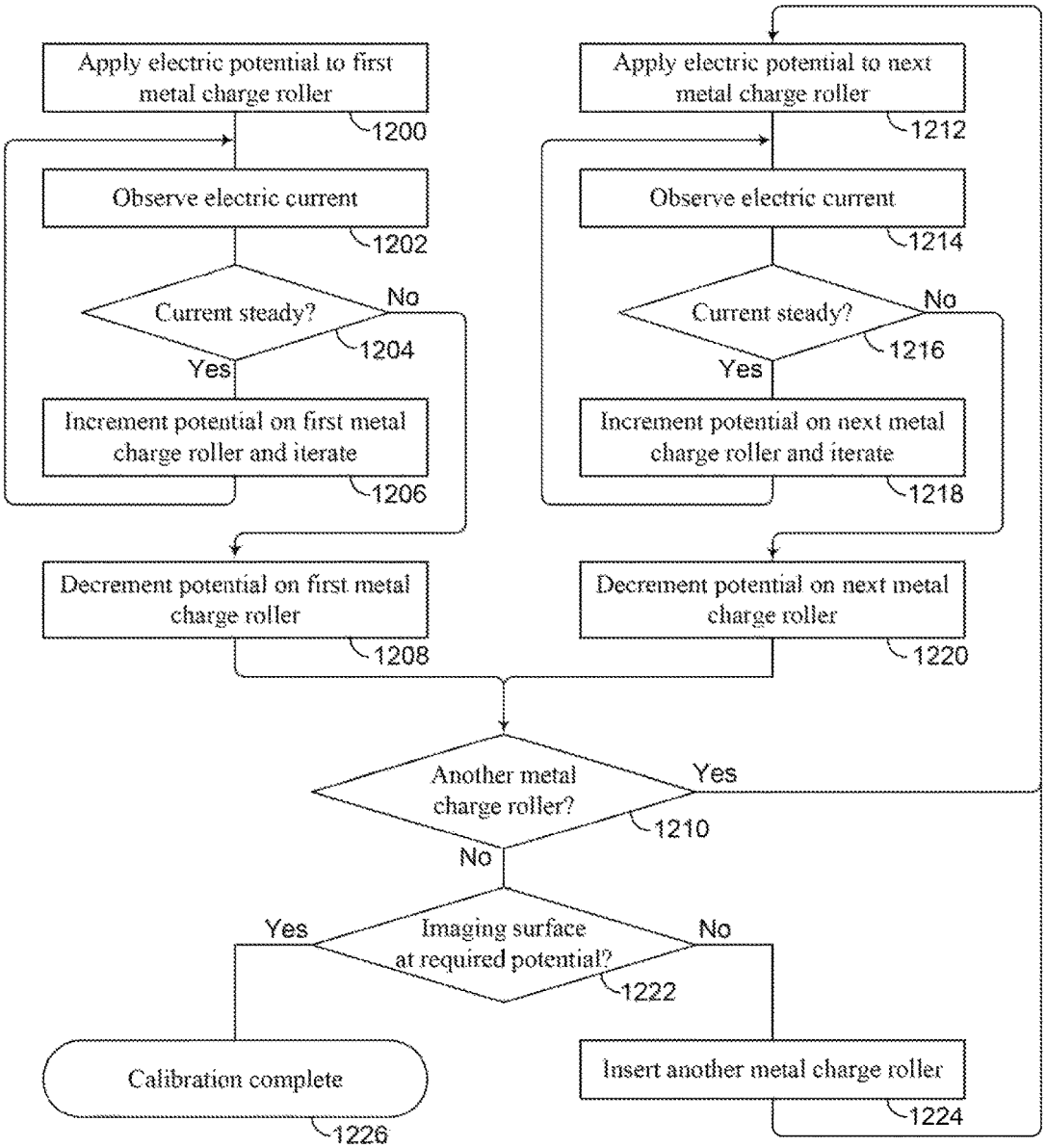
FIG. 12 is a flowchart showing an example of calibrating a printer having an imaging surface and one or more metal charge rollers in charge-transferring relationship with the imaging surface.
Figure 13:
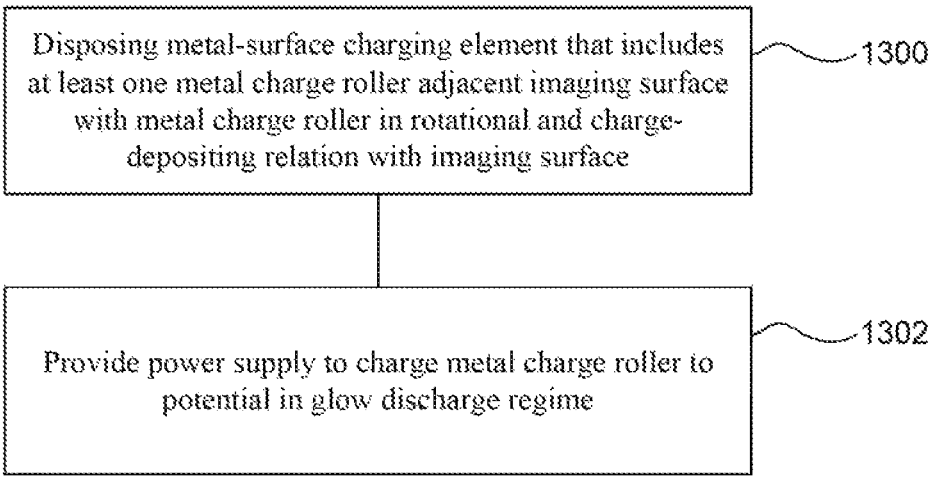
FIG. 13 is a flowchart giving an example of a method of manufacturing a printing system with a metal-surface charge element.

In some examples, as shown in FIG. 12, electrically charging the imaging surface comprises calibrating the printer prior to printing by:

applying an electric potential to a first one of the metal charge rollers (1200);

observing the electric current drawn by the first metal charge roller (1202), a steady current indicating that the metal charge roller is operating in the glow discharge regime, as shown in FIG. 2;

if the current is steady (1204), incrementing the potential on the first metal charge roller and iterating (1206), that is, continuing to observe the electric current drawn by the first metal charge roller and increment the potential in any convenient amount so as to charge the first metal charge roller to maximum glow discharge potential;

if the current fluctuates (1204), which indicates that the first metal charge roller has started to enter the streamer discharge regime, decrementing the potential on the first metal charge roller (1208) to return the first metal charge roller back to the glow discharge region, at which point the potential on the first metal charge roller is known to be as high as it can go without entering the streamer discharge region;

if there is a next metal charge roller (1210), applying an electric potential to that next metal charge roller (1212), observing the electric current drawn by that next metal charge roller (1214), if the current is steady (1216) incrementing the potential on that next metal charge roller (1218) and iterating, and if the current fluctuates decrementing the potential on that next metal charge roller (1220); and repeating until there are no more metal charge rollers.

In some examples the method also includes determining whether the imaging surface has charged to a predetermined print potential (1222), and if not, inserting another metal charge roller (1224), applying an electric potential to that metal charge roller as described above (1212), observing the electric current drawn by that metal charge roller as described above (1214), if the current is steady incrementing the potential on that metal charge roller and iterating (1216), and if the current fluctuates decrementing the potential on that medal charge roller (1218). If the imaging surface is charged to the predetermined print potential (1222), the calibration is complete (1224).

The foregoing steps of applying a potential to each metal charge roller in sequence and incrementing or decrementing depending on current flow may also be used to find proper operating potentials for each metal charge roller in any printer with multiple metal charge rollers; these operating potentials may vary depending on printer and environmental parameters.

In some examples the printer has a fixed number of metal charge rollers installed. In this case, "installing" a next metal charge roller may require applying a potential to a next metal charge roller that is already in place and connected to a power supply, or it may require establishing an electrical connection between the next metal charge roller and the power supply. If at the end of the configuration process any metal charge roller remains without an electric potential having been applied to it, it may receive the same potential as that applied to the immediately preceding metal charge roller.

In other examples, the number of metal charge rollers initially in the printer is not fixed. In this case, the configuration procedure is begun with a minimum number of metal charge rollers installed, and if the calibration does not charge the imaging surface up to the required potential, "installing" a next metal charge roller requires physically positioning another metal charge roller in the printer.

Applying the electric potential to the first metal charge roller may require starting with a known minimum value. In the example of FIG. 3, this known minimum value might be 580 volts. Or the known minimum value might be adjusted up or down according to physical conditions in the environment of the printer. Examples of these physical conditions are gap width, temperature, humidity, or any of the various other parameters given previously.

A method of manufacturing a printing system includes disposing a metal-surface charge element that includes at least one metal charge roller adjacent an imaging surface with each metal charge roller in rotational and charge-depositing relation with the imaging surface (1300) and providing a power supply to charge each metal charge roller to a potential within a glow discharge regime (1302).

Using a metal-surface charge element with one or more metal charge rollers each operating within its glow discharge regime, rather than a charge roller having a conductive rubber surface, eliminates or reduces the time and expense of charge-roller replacement, thereby significantly reducing the cost-per-page of high-volume digital printing. Chemicals do not leach from metal charge rollers. Metal charge rollers are not adversely affected by environmental factors such as humidity or temperature. Metal charge rollers are simpler and less expensive to manufacture than rubber-coated rollers. Eliminating the rubber-coated roller may also eliminate any need for a balancing roller and a seam-treatment solenoid in some kinds of printers.

We claim:

1. A printing system comprising:

a metal-surface charge element that includes at least one metal charge roller to deposit electric charge on an imaging surface, each metal charge roller including a metal external surface in charge-transferring relation with the imaging surface and in a glow discharge regime during operation of the printing system for printing, wherein the glow discharge regime excludes filamentary streamer discharges; and a power supply connected to each metal charge roller to provide electric charge to each metal charge roller at a potential within the glow discharge regime, wherein the at least one metal charge roller comprises:

at least two metal charge rollers to deposit a target electric charge on the imaging surface in steps such that, during operation of the printing system for printing, each metal charge roller of the at least two metal charge rollers deposits, via the power supply, a respective portion of the target electric charge on the imaging surface while remaining in the glow discharge regime, wherein a sum of the respective portions of electric charge equals the target electric charge, and wherein the sum of the respective portions of electric charge would result in filamentary streamer discharge behavior outside of the glow discharge regime if the sum of respective portions of electric charge was applied in a single step.

2. The printing system of claim 1, comprising:

a discharge source aimed at the imaging surface;

at least one ink developer roller in ink-dispensing relation with the imaging surface; and a transfer unit in ink-transferring relation with the imaging surface, the transfer unit defining a paper movement path.

3. The printing system of claim 2 wherein the discharge source comprises one of a laser and an image-forming energy source.

4. The printing system of claim 1 wherein the at least one metal charge roller is spaced apart from the imaging surface.

5. The printing system of claim 1 wherein the printing system comprises a liquid electrophotographic printer.

6. The printing system of claim 1, wherein at least some of the excluded filamentary streamer discharges have an amplitude of current that is at least one order of magnitude greater than an amplitude of current in the glow discharge regime.

7. The printing system of claim 1, wherein the target electric charge corresponds to an imaging surface-to-ground potential.

8. The printing system of claim 7, wherein the target electric charge is at least 500 Volts.

9. The printing system of claim 1 wherein the at least one metal charge roller comprises a solid metal cylinder.

10. The printing system of claim 1 wherein the at least one metal charge roller comprises a hollow metal cylinder.

11. The printing system of claim 1, wherein an amplitude of current in the glow discharge regime is at least one order of magnitude less than an amplitude of current of at least some of the excluded filamentary streamer discharges.

12. The printing system of claim 1, wherein an upper boundary of the glow discharge regime is at least partially defined by a first threshold associated with temporal fluctuation in current amplitude of the metal charge roller.

13. The printing system of claim 12, wherein the upper boundary corresponds to a charge-roller potential at which measurements of the temporal fluctuation exceed the first threshold.

14. A printing system comprising:

a metal-surface charge element including:

at least two metal charge rollers with each metal charge roller including a metal external surface in charge-transferring relation with the imaging surface and in a glow discharge regime during operation of the printing system for printing, the at least two metal charge rollers to deposit electric charge on an imaging surface in steps such that each metal charge roller deposits a portion of a target electric charge on the imaging surface; and a power supply to provide a first portion of the target electric charge via a first one of the metal charge rollers via a first potential within the glow discharge regime between the first metal charge roller and the imaging surface and to provide subsequent portions of the target electric charge via each metal charge roller after the first portion at a subsequent potential within the glow discharge regime between that metal charge roller and the imaging surface after being charged by the previous metal charge roller, wherein a sum of the first portion and subsequent portions equals the target electric charge, and wherein a sum of the first potential and subsequent potentials would result in at least some filamentary streamer discharge behavior outside of the glow discharge regime if applied in a single step via a single metal charge roller.

15. The printing system of claim 14, wherein the sum of the first potential and subsequent potentials is 1600 Volts.

16. A method of operating a printer with a metal-surface charge element, the method comprising:

electrically charging an imaging surface of the printer by applying electric charge in a glow discharge regime to a metal-surface charge element that includes at least two metal charge rollers, each metal charge roller in rotational and charge-transferring relation with the imaging surface, wherein electrically charging the imaging surface comprises, in a first step, applying a first potential within the glow discharge regime between a first metal charge roller and the imaging surface and, after the first metal charge roller, in subsequent steps applying subsequent potentials within the glow discharge regime between each subsequent metal charge roller and the imaging surface after being charged by the previous metal charge roller, wherein a sum of the first potential and all subsequent potentials would be within a filamentary streamer discharge regime if applied in a single step via a single metal charge roller;

forming a charge image on the electrically-charged imaging surface;

applying ink to the imaging surface to image the ink according to the charge image; and transferring the imaged ink to paper.

17. The method of claim 16 wherein electrically charging the imaging surface comprises calibrating the printer prior to printing by:

applying an electric potential to a first one of the metal charge rollers, observing the electric current drawn by the first metal charge roller, and if the current is steady incrementing the potential on the first metal charge roller and iterating, and if the current fluctuates, decrementing the potential on the first metal charge roller;

if there is a next metal charge roller, applying an electric potential to that next metal charge roller, observing the electric current drawn by that next metal charge roller, and if the current is steady, then incrementing the potential on that next metal charge roller and iterating, and if the current fluctuates decrementing the potential on that next metal charge roller; and repeating until there are no more metal charge rollers.

18. The method of claim 17 and further comprising determining whether the imaging surface has charged to a predetermined print potential, and if not, inserting another metal charge roller, applying an electric potential to that metal charge roller, observing the electric current drawn by that metal charge roller, and if the current is steady incrementing the potential on that metal charge roller and iterating, and if the current fluctuates decrementing the potential on that metal charge roller.

19. The method of claim 18 wherein inserting another metal charge roller comprising physically installing that metal charge roller in the printer.

20. A printing system comprising:

a metal-surface charge element that includes at least one metal charge roller to deposit electric charge on an imaging surface, each metal charge roller including a metal external surface in charge-transferring relation with the imaging surface and in a glow discharge regime during operation of the printing system for printing, wherein the glow discharge regime excludes filamentary streamer discharges; and wherein the at least one metal charge roller comprises at least two metal charge rollers to deposit a target electric charge on the imaging surface in steps such that, during operation of the printing system for printing, each metal charge roller of the at least two metal charge rollers deposits, via the power supply, a respective portion of the target electric charge on the imaging surface while remaining in the glow discharge regime, wherein the target electric charge corresponds to an imaging surface-to-ground potential, wherein the target electric charge is at least 1000 Volts.

21. A printing system, comprising:

a metal-surface charge element that includes a plurality of metal charge rollers to deposit electric charge on an imaging surface, each metal charge roller including a metal external surface in charge-transferring relation with the imaging surface and in a glow discharge regime during operation of the printing system for printing, wherein the glow discharge regime excludes filamentary streamer discharges; and a power supply to provide a first portion of electric charge to the imaging surface via a first one of the metal charge rollers via a first potential within the glow discharge regime between the first metal charge roller and the imaging surface and to provide subsequent portions of electric charge to the imaging surface via each metal charge roller after the first at a subsequent potential within the glow discharge regime between that metal charge roller and the imaging surface after being charged by the previous metal charge roller, wherein a sum of the first portion and subsequent portions equals the target electric charge and wherein a sum of the first potential and subsequent potentials would produce streamer discharge behavior if applied in a single step to a single metal charge roller.

* * * * *